US011583080B2

(12) United States Patent
Chen

(10) Patent No.: US 11,583,080 B2
(45) Date of Patent: Feb. 21, 2023

(54) COMBINED STORAGE SHELF

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 17/679,141

(22) Filed: Feb. 24, 2022

(65) Prior Publication Data

US 2022/0361672 A1 Nov. 17, 2022

(30) Foreign Application Priority Data

May 13, 2021 (TW) ..... 110117191
Jan. 27, 2022 (TW) ..... 111103538

(51) Int. Cl.

| | |
|---|---|
| ***A47B 96/04*** | (2006.01) |
| ***A47B 47/02*** | (2006.01) |
| ***A47B 96/06*** | (2006.01) |
| *A47B 57/16* | (2006.01) |
| *A47B 47/00* | (2006.01) |
| *A47B 57/40* | (2006.01) |

(52) U.S. Cl.

CPC ..... *A47B 96/04* (2013.01); *A47B 47/021* (2013.01); *A47B 96/066* (2013.01); *A47B 47/00* (2013.01); *A47B 57/16* (2013.01); *A47B 57/40* (2013.01)

(58) Field of Classification Search

CPC ..... A47B 96/04; A47B 96/066; A47B 47/021; A47B 47/00; A47B 47/0083; A47B 47/024; A47B 57/12; A47B 57/54; A47B 57/545; A47B 88/407; A47B 96/06; A47B 96/1441; A47B 87/001; A47B 87/021; A47B 55/02; A47B 57/06; A47B 57/08; A47B 57/16; A47B 57/30; A47B 57/32; A47B 57/40; A47F 5/13; A47F 5/01

See application file for complete search history.

(56) References Cited

U.S. PATENT DOCUMENTS

| | | | | | |
|---|---|---|---|---|---|
| 2,894,643 | A * | 7/1959 | Maslow | ..... | A47B 55/02 211/189 |
| 2,919,816 | A * | 1/1960 | Maslow | ..... | A47B 55/02 403/217 |
| 2,970,702 | A * | 2/1961 | Maslow | ..... | A47B 55/02 108/106 |
| 3,138,123 | A * | 6/1964 | Maslow | ..... | A47F 5/13 108/159 |

(Continued)

*Primary Examiner* — Devin K Barnett
(74) *Attorney, Agent, or Firm* — WPAT, PC

(57) ABSTRACT

A combined storage shelf is provided, including double-bracing side racks, connection and combination fasteners, storage layers, and beam structures. Each of the double-bracing side racks includes a first upright rod, a second upright rod, and horizontal rods. Each of the connection and combination fasteners includes a body portion, two side portions, fitting grooves, and fastening structures. The storage layers are disposed in the beam structures. Each of the beam structures includes a beam member and beam connection and combination fasteners. Each of the beam connection and combination fasteners includes beam fastening structures. Each of the beam fastening structures is snapped into a fastening structure, so that the beam structures are connected to the connection and combination fasteners.

7 Claims, 14 Drawing Sheets

(56) References Cited

U.S. PATENT DOCUMENTS 3,146,735 A * 9/1964 Kesilman ..... A47F 5/13 108/181
3,208,408 A * 9/1965 Maslow ..... A47F 5/13 211/186
3,316,864 A * 5/1967 Maslow ..... A47B 57/54 211/186
4,079,678 A * 3/1978 Champagne ..... A47B 57/545 108/106
4,592,286 A * 6/1986 Trubiano ..... A47B 57/545 211/208
4,735,325 A * 4/1988 Remmers ..... A47B 96/068 211/187
4,778,066 A * 10/1988 Stjernberg ..... A47B 55/02 211/186
5,027,959 A * 7/1991 Luukkonen ..... A47B 47/021 211/186
5,065,873 A * 11/1991 Tseng ..... A47B 57/54 211/186
5,221,014 A * 6/1993 Welch ..... A47F 5/13 211/187
5,833,084 A * 11/1998 Chang ..... A47B 55/02 211/90.03
6,119,881 A * 9/2000 Yang ..... A47B 55/02 211/189
9,585,469 B2 * 3/2017 Huang ..... A47B 47/021
10,980,344 B1 * 4/2021 Yang ..... A47B 96/1466
11,419,412 B1 * 8/2022 Chen ..... A47B 96/1441
2001/0006163 A1 * 7/2001 Scudeller ..... A46B 17/02 211/182
2007/0108147 A1 * 5/2007 Chen ..... A47B 47/00 211/187
2011/0220602 A1 * 9/2011 Chen ..... A47B 87/001 248/250
2012/0298606 A1 * 11/2012 Chen ..... A47B 57/265 211/186
2012/0298607 A1 * 11/2012 Chen ..... A47B 57/265 211/186
2015/0069000 A1 * 3/2015 Rosen ..... A47F 5/01 211/186

* cited by examiner

COMBINED STORAGE SHELF

CROSS REFERENCE TO RELATED APPLICATION

This application claims the benefits of Taiwan application Serial No. 110117191, filed on May 13, 2021, and Taiwan application Serial No. 111103538, filed on Jan. 27, 2022, and the disclosures of which are incorporated by references herein in its entirety.

BACKGROUND

Technical Field

The present disclosure relates to a storage shelf, and in particular, to a combined storage shelf.

Related Art

Combined furniture may be randomly combined into appropriate shapes and sizes according to the requirements of home, office, or workplace, and is becoming more and more popular due to the advantages of convenient transportation and storage.

Combined furniture, for example, a combined storage shelf, uses screws, bolts, and the like to lock and fasten tube fittings and horizontal frame to form the combined storage shelf. For example, a storage layer is disposed between left and right double-bracing side racks to form a storage shelf with double-bracing side racks. The double-bracing side rack includes two upright rods on the left and right side in parallel at the front and the rear respectively, and at least two horizontal iron wires disposed up and down. Front and rear ends of the iron wires are respectively welded with the upright rods located at the front and rear positions. According to the combined storage shelf with the double-bracing side rack, the entire shelf is mainly fastened by hooking locking iron plates on wooden boards to horizontal iron wires and then disposing cross-shaped traction wires at a rear end of the double-bracing side rack. Tools are required for assembly and use, causing inconvenience in assembly and use.

Therefore, how to resolve the problems encountered by using the conventional method is one of the issues to be resolved by the industry.

SUMMARY

The present disclosure provides a combined storage shelf, which uses a beam structure to replace a cross-shaped traction wire structure of the conventional technology, and achieves a simple and stable overall structure that is easy to assemble and has high flexibility in overall assembly without tools for assembly. In addition, the combined storage shelf can be assembled as long as a connection and combination fastener is assembled to one of a first upright rod or a second upright rod in a double-bracing side rack. In this way, the costs of manufacturing the connection and combination fastener can be effectively reduced.

An embodiment of the present disclosure provides a combined storage shelf, including at least two double-bracing side racks, a plurality of connection and combination fasteners, a plurality of storage layers, and a plurality of beam structures. Each of the double-bracing side racks comprises two upright rod combinations and a plurality of horizontal rods. The horizontal rods are disposed between the upright rod combinations. Each of the upright rod combinations comprises a first upright rod and a second upright rod. The first upright rod and the second upright rod are disposed in parallel. Two ends of the horizontal rods are respectively fastened between the first upright rod and the second upright rod. Each of the connection and combination fasteners comprises a body portion, a first side portion, a second side portion, a fitting groove, and at least one fastening structure. Two sides of the body portion respectively extend to form the first side portion and the second side portion. The fastening structure is disposed in the corresponding first side portion. The fitting groove is provided in the second side portion. The second side portion is inserted between the first upright rod and the second upright rod. The horizontal rods are fastened to the corresponding fitting grooves, so that the body portion and the first side portion are respectively located on an outer side of the first upright rod or the second upright rod. Each storage layer is located between the double-bracing side racks, and the storage layer is disposed in a corresponding beam structure. Each beam structure comprises a beam member and two beam connecting fasteners, and the beam connecting fasteners are respectively connected to two sides of the corresponding beam member. Each beam connecting fastener comprises at least one beam fastening structure. The beam fastening structure is snapped into a corresponding fastening structure, so that the beam structures are connected to the corresponding connection and combination fasteners.

In an embodiment, each of the connection and combination fasteners comprises a first connection and combination fastener and a second connection and combination fastener. Each of the first connection and combination fastener and the second connection and combination fastener comprises a protrusion portion and a concave hole portion. The protrusion portion is connected to the body portion. The protrusion portion protrudes from one side of the body portion. The concave hole portion is adjacent to the protrusion portion. The protrusion portion of the first connection and combination fastener engaged with the concave hole portion of the second connection and combination fastener. The concave hole portion of the first connection and combination fastener is engaged with the protrusion portion of the second connection and combination fastener. Therefore, the first connection and combination fastener and the second connection and combination fastener are assembled together.

In an embodiment, the combined storage shelf further includes a plurality of fitting portions. The fitting portions are connected to the beam members.

In an embodiment, the combined storage shelf further comprises a fitting. The fitting comprises a plurality of hook portions. The hook portions are hooked to the fitting portions.

In an embodiment, the combined storage shelf further includes a plurality of positioning slots. The positioning slots are provided between the fitting portions, between the fitting portions and the corresponding beam connecting fasteners, or within the beam connecting fasteners. The positioning slots are configured to hold at least one corresponding partition member, to position partition members on the storage layers.

In an embodiment, the partition members can form a drawer cabinet, a door cabinet, or a storage cabinet.

In an embodiment, the fastening structure is a fitting hole of the side portion.

Based on the above, according to the combined storage shelf provided in the present disclosure, a beam structure is engaged with fastening structures of connection and combination fasteners on double-bracing side racks without tools for assembly, to achieve the purpose of engagement. In addition, the beam structure is used to stabilize the entire combined storage shelf without the need for the conventional cross-shaped traction wire structure.

Further, in the present disclosure, the combined storage shelf can be assembled as long as the connection and combination fastener is assembled to one of a first upright rod or a second upright rod in the double-bracing side rack. In this way, the costs of manufacturing the connection and combination fastener can be effectively reduced.

In addition, the beam structure includes a hooking function, and a fitting may be added according to actual needs, to make the entire combined storage shelf more flexible in assembly.

In order to make the present disclosure more comprehensible, embodiments accompanied with figures are described in detail below.

DETAILED DESCRIPTION

Figure 1:
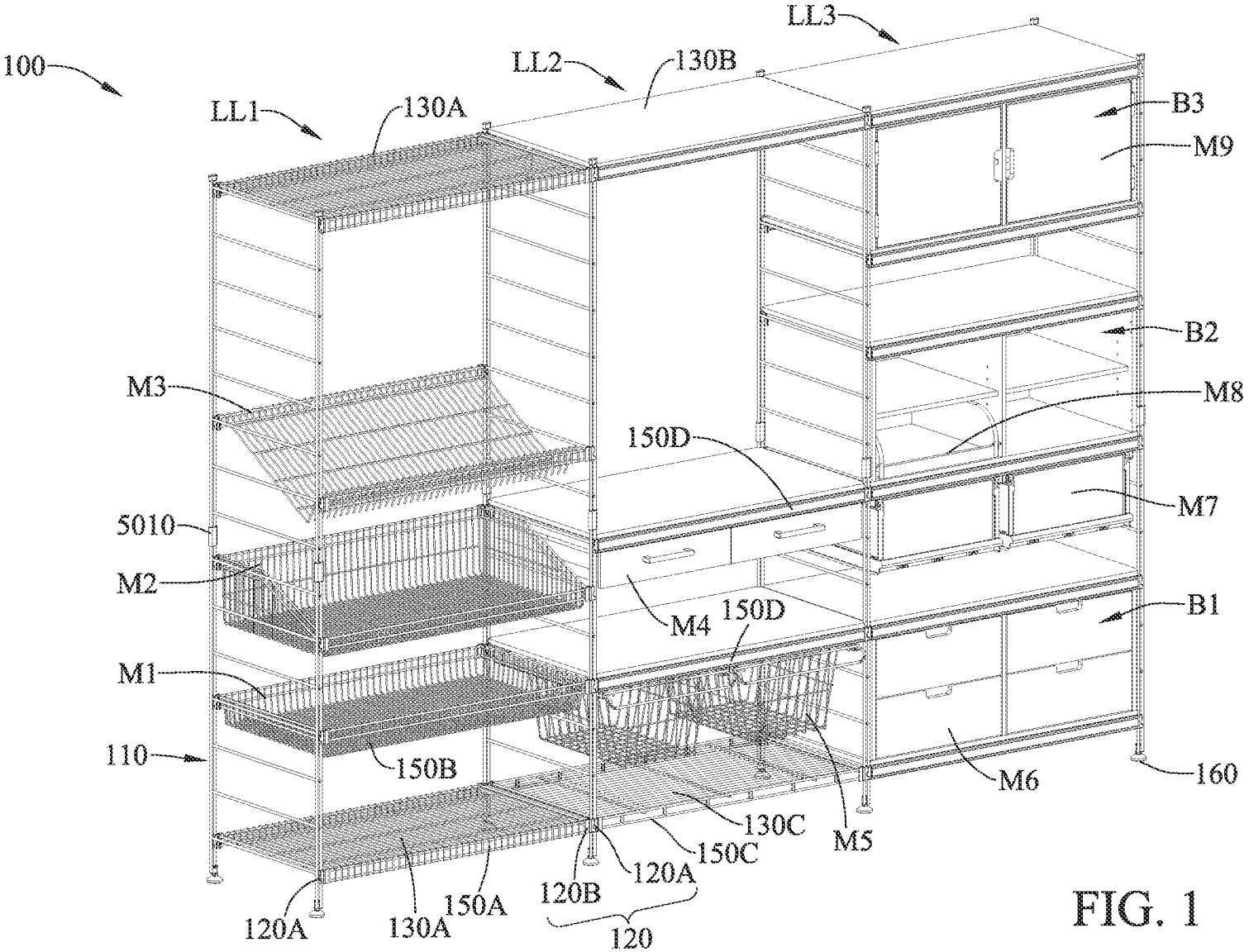
FIG. 1 is a schematic diagram of a combined storage shelf according to an embodiment of the present disclosure.

The following further describes specific implementations of the present disclosure with reference to the accompanying drawings and the embodiments. The following embodiments are merely used for more clearly describing the technical solutions of the present disclosure, and are not intended to limit the protection scope of the present disclosure.

It should be noted that, in description of the embodiments, terms such as "first" and "second" are used for describing different components, and the components are not limited by such terms. In the description of the embodiments, the "coupled" or "connected" may refer to two or more components in direct physical or electrical contact with each other, or in indirect physical or electrical contact with each other. Moreover, "coupled" or "connected" may further refer to a mutual operation or action of two or more components.

In addition, for convenience and clarity of the description, thicknesses or sizes of the components in the drawings expressed in an exaggerated, omitted or general manner are used to help a person skilled in the art to understand and read, and the sizes of components are not completely actual sizes and are not intended to limit restraint conditions under which the present disclosure can be implemented and therefore have no technical significance. Any modification to the structure, change to the proportional relationship or adjustment on the size should fall within the scope of the technical content disclosed by the present disclosure without affecting the effects and the objectives that can be achieved by the present disclosure. Same reference numerals are used to denote same or similar components in all of the drawings.

FIG. 1 is a schematic diagram of a combined storage shelf according to an embodiment of the present disclosure. Referring to FIG. 1, in this embodiment, a combined storage shelf 100 includes at least two double-bracing side racks 110 (for example, including four double-bracing side racks 110 in FIG. 1), a plurality of connection and combination fasteners 120, storage layers (for example, one or any combination of a plurality of different types of storage layers such as a first storage layer 130A, a second storage layer 130B, and a third storage layer 130C), and beam structures (for example, one or any combination of beam structures 150A, 150B, 150C, or 150D), through which a combined storage shelf of various combinations can be formed.

A quantity of double-bracing side racks 110, a quantity of different types of storage layers such as the first storage layer 130A, the second storage layer 130B, and the third storage layer 130C, the related connection and combination fasteners 120, and the beam structures 150A, 150B, 150C, and 150D in the present disclosure can be adjusted according to actual conditions. For example, left and right double-bracing side racks 110 are fastened to each other by disposing the beam structures (for example, the beam structure 150A, 150B, 150C, and 150D) engaged with fastening structures C1 and C2 of the connection and combination fasteners 120. In addition, one row of at least one storage layer (for example, the first storage layer 130A, the second storage layer 130B, or the third storage layer 130C) of the same or different types is disposed correspondingly on a combined storage shelf. That is, the present disclosure can achieve the joint assembly by using the double-bracing side racks 110, the beam structures (for example, the beam structures 150A, 150B, 150C, or 150D), and the connection and combination fasteners 120 without tools for assembly. In addition, the beam structures (for example, the beam structures 150A, 150B, 150C, or 150D) can stabilize the entire combined storage shelf without the need for the conventional cross-shaped traction wire structure.

In an embodiment, in the present disclosure, at least one fitting (for example, a sliding groove structure 270, or a drawer track structure 380) may be disposed to improve the assembly flexibility of the present disclosure. In another embodiment, the stability of the entire combined storage shelf 100 can be improved by further disposing feet 160 under the double-bracing side racks 110.

Taking FIG. 1 as an example, there are a first row LL1, a second row LL2, and a third row LL3 from left to right in sequence. The first row LL1 includes four layers, the second row LL2 includes three layers, and the third row LL3 includes five layers. In an embodiment, the heights of the double-bracing side racks 110 in the first row LL1, the second row LL2, and the third row LL3 can be increased through assembly of connectors 5010. It should be noted that, in the present disclosure, the combined storage shelf 100 can be assembled into a first storage shelf body M1, a second storage shelf body M2, a third storage shelf body M3, a drawer M4, a storage basket M5, a drawer M6, a storage box M7, a box body M8, and a sliding door M9.

Figure 2:
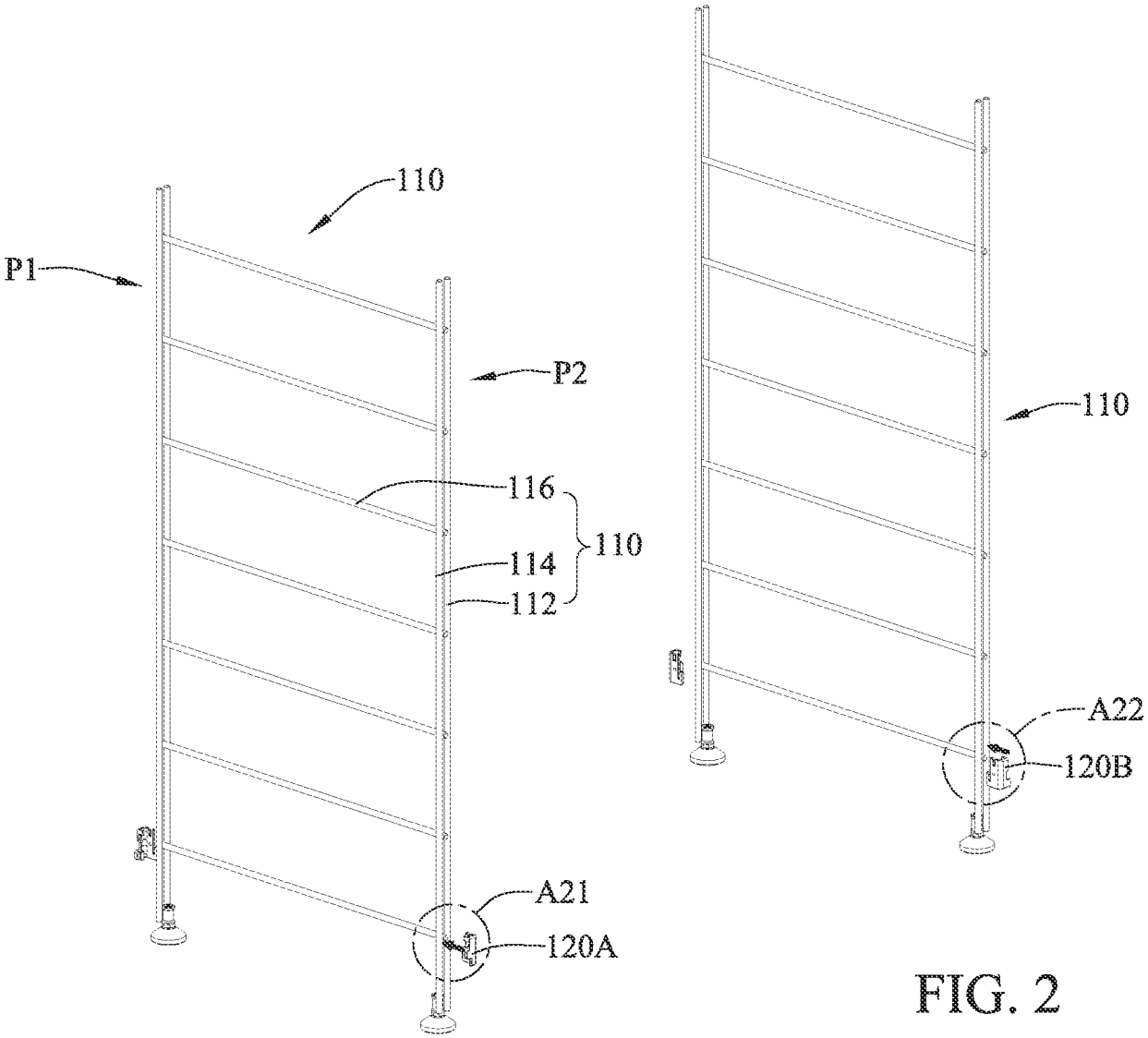
FIG. 2 is a schematic diagram of a double-bracing side rack before assembly according to an embodiment of the present disclosure.
Figure 3B:
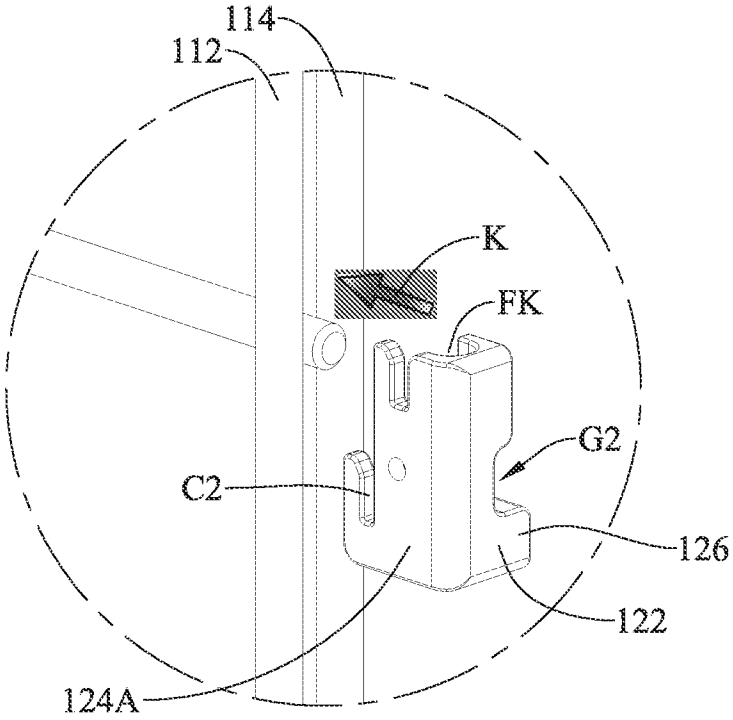
FIG. 3B is a schematic diagram of a region A22 from another perspective.
Figure 3A:
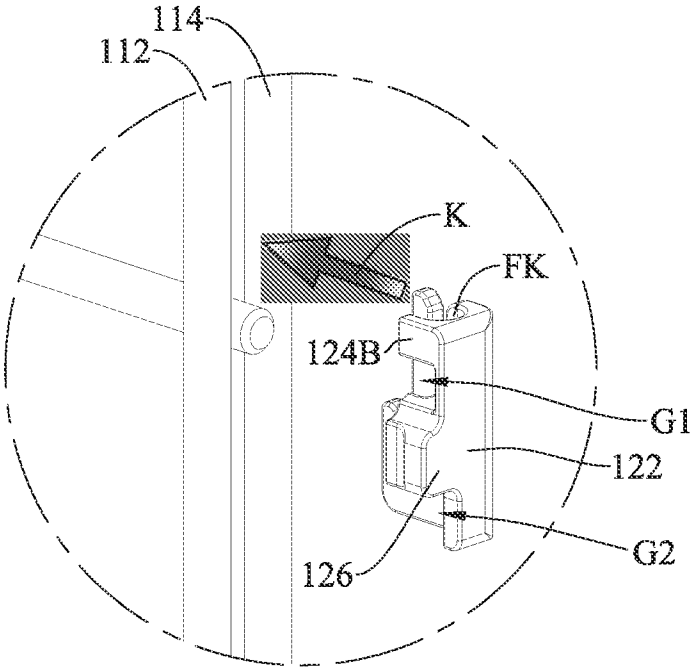
FIG. 3A is a partial enlarged view of a region A21 of FIG. 2.
Figure 3D:
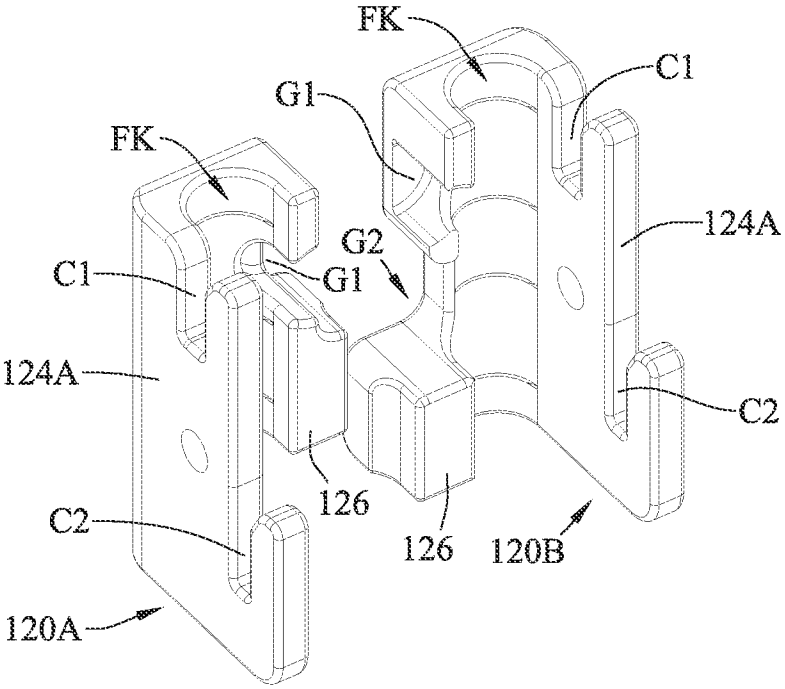
FIG. 3D is a schematic diagram of FIG. 3C from another perspective.
Figure 3C:
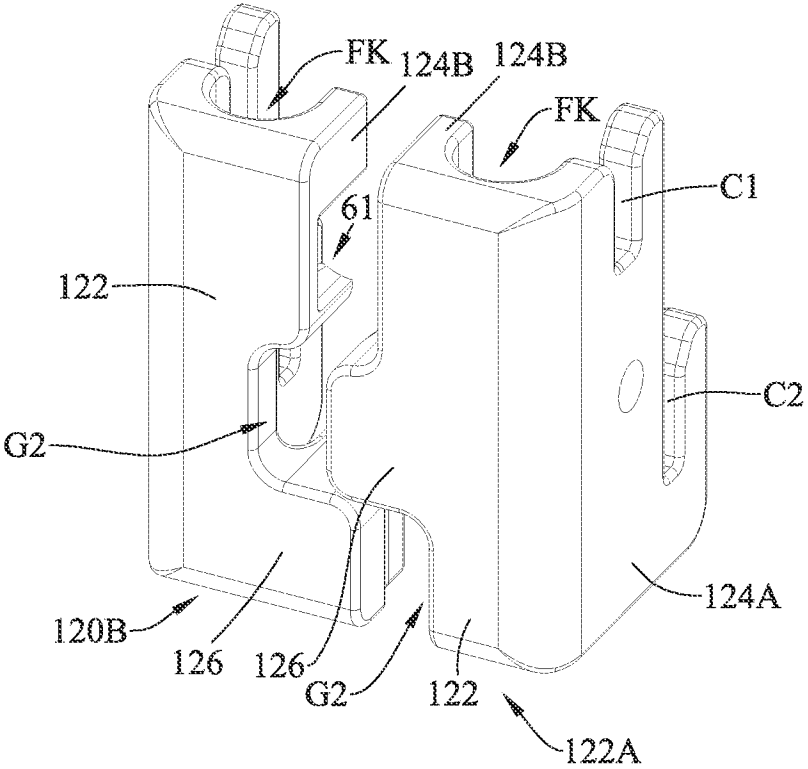
FIG. 3C is a schematic diagram of a connection and combination fastener according to an embodiment.

FIG. 2 is a schematic diagram of a double-bracing side rack before assembly according to an embodiment of the present disclosure. FIG. 3A is a partial enlarged view of a region A21 of FIG. 2. FIG. 3B is a schematic diagram of a region A22 from another perspective. FIG. 3C is a schematic diagram of a connection and combination fastener according to an embodiment. FIG. 3D is a schematic diagram of FIG. 3C from another perspective. Referring to FIG. 1 to FIG. 3D, in this embodiment, each of the double-bracing side racks 110 includes two upright rod combinations P1 and P2 and a plurality of horizontal rods 116. The horizontal rods 116 are disposed between the two upright rod combinations P1 and P2. Each of the upright rod combinations P1 and P2 includes a first upright rod 112 and a second upright rod 114. The first upright rod 112 and the second upright rod 114 are disposed in parallel to form the upright rod combination P1 or the upright rod combination P2. Two ends of the horizontal rods 116 are respectively fastened between the first upright rod 112 and the second upright rod 114. There is a space between the first upright rod 112 and the second upright rod 114 for the two ends of the horizontal rods 116 to be inserted.

In this embodiment, each of the connection and combination fasteners 120 includes a body portion 122, a first side portion 124A, a second side portion 124B, a fitting groove G1, and two fastening structures C1 and C2. Two sides of the body portion 122 respectively extend to form the first side portion 124A and the second side portion 124B. Each of the fastening structures C1 and C2 is disposed in the first side portion 124A. That is, the fastening structures C1 and C2 are disposed on a lateral side of the body portion 122. The first side portion 124A includes two fastening structures C1 and C2 with different positions (for example, at different heights). That is, in the present disclosure, the two fastening structures C1 and C2 are disposed on a lateral side portion of the body portion 122, but a quantity of fastening structures C1 and C2 may depend on actual needs. For example, the fastening structures C1 and C2 are fitting holes in the first side portion 124A. The fastening structure C1 may be a fitting hole recessed in one edge of the first side portion 124A, or the fastening structure C2 may be a fitting hole protruding and extending from a lateral side of the first side portion 124A, but the present disclosure is not limited thereto. The quantity and positions of fastening structures C1 and C2 may depend on actual needs. In this embodiment, the fitting groove G1 is provided in the second side portion 124B. The fitting groove G1 is a fitting hole in the second side portion 124B. The second side portion 124B is inserted between the first upright rod 112 and the second upright rod 124. Each of the horizontal rods 116 is fastened to the corresponding fitting groove G1. Therefore, the body portion 122 and the first side portion 124A connected to the body portion 122 are respectively located on an outer side of the second upright rod 114. That is, in this embodiment, the flexible assembly is achieved by assembling the connection and combination fastener 120 to the first upright rod 112 or the second upright rod 114.

In addition to the above, the present disclosure does not limit the type of the connection and combination fastener 120. In another embodiment, the connection and combination fastener 120 includes a protrusion portion 126. The protrusion portion 126 is connected to the body portion 122. The protrusion portion 126 protrudes from one side of the body portion 122.

It should be noted that, as shown in FIG. 2, the connection and combination fastener 120 includes a first connection and combination fastener 120A and a second connection and combination fastener 120B. Each of the first connection and combination fastener and the second connection and combination fastener roughly includes a body portion 122, a first side portion 124A, a second side portion 124B, a fitting groove G1, and two fastening structures C1 and C2, whose structural types are described above. In addition, in the present disclosure, the first connection and combination fastener 120A and the second connection and combination fastener 120B can be assembled with each other. As shown in FIG. 3C and FIG. 3D, a position of the protrusion portion 126 of the first connection and combination fastener 120A is different from a position of the protrusion portion 126 of the second connection and combination fastener 120B. Moreover, a position of the protrusion portion 126 of the first connection and combination fastener 120A corresponding to the second connection and combination fastener 120B includes a concave hole portion G2, and a position of the protrusion portion 126 of the second connection and combination fastener 120B corresponding to the first connection and combination fastener 120A includes a concave hole portion G2. The protrusion portion 126 of the first connection and combination fastener 120A is engaged with the concave hole portion G2 of the second connection and combination fastener 120B. The concave hole portion G2 of the first connection and combination fastener 120A is engaged with the protrusion portion 126 of the second connection and combination fastener 120B. Therefore, the first connection and combination fastener 120A and the second connection and combination fastener 120B are assembled together.

It should be noted that, as shown in FIG. 2, the first connection and combination fastener 120A is assembled to the second upright rod 114 of the double-bracing side rack 110. The second connection and combination fastener 120B is assembled to the first upright rod 112 of the double-bracing side rack 110. That is, in the present disclosure, the combined storage shelf can be assembled as long as the connection and combination fastener 120 is assembled to one of the first upright rod 112 or the second upright rod 114 in the double-bracing side rack 110. In this way, the costs of manufacturing the connection and combination fastener 120 can be effectively reduced.

In this embodiment, the connection and combination fastener 120 includes an assembly direction K toward the double-bracing side rack 110. The protrusion portion 126 and the second side portion 124B are both protrusions extending from the body portion 122. In addition, the protrusion portion 126 and the second side portion 124B are protrusions located on the same side but at different positions of the body portion 122. The second side portion 124B and the first side portion 124A are protrusions extending from the body portion 122 toward the assembly direction K. That is, the first side portion 124A and the second side portion 124B are formed by bending the surface of the body portion 122, so that the appearance of the body portion 122 is U-shaped. Moreover, a receiving groove FK is provided between the first side portion 124A and the second side portion 124B. In another aspect, the protrusion portion 126 is formed by extending from the surface of the body portion 122. That is, an extending direction of the protrusion portion 126 is different from an extending direction of the second side portion 124B.

In this embodiment, the receiving groove FK is configured to receive the second upright rod 114 and the first upright rod 112. That is, the receiving groove FK is in a groove shape, the shape thereof matches the shapes of the first upright rod 112 and the second upright rod 114. The shapes and sizes of the first upright rod 112 and the second upright rod 114 are the same.

Figure 4A:
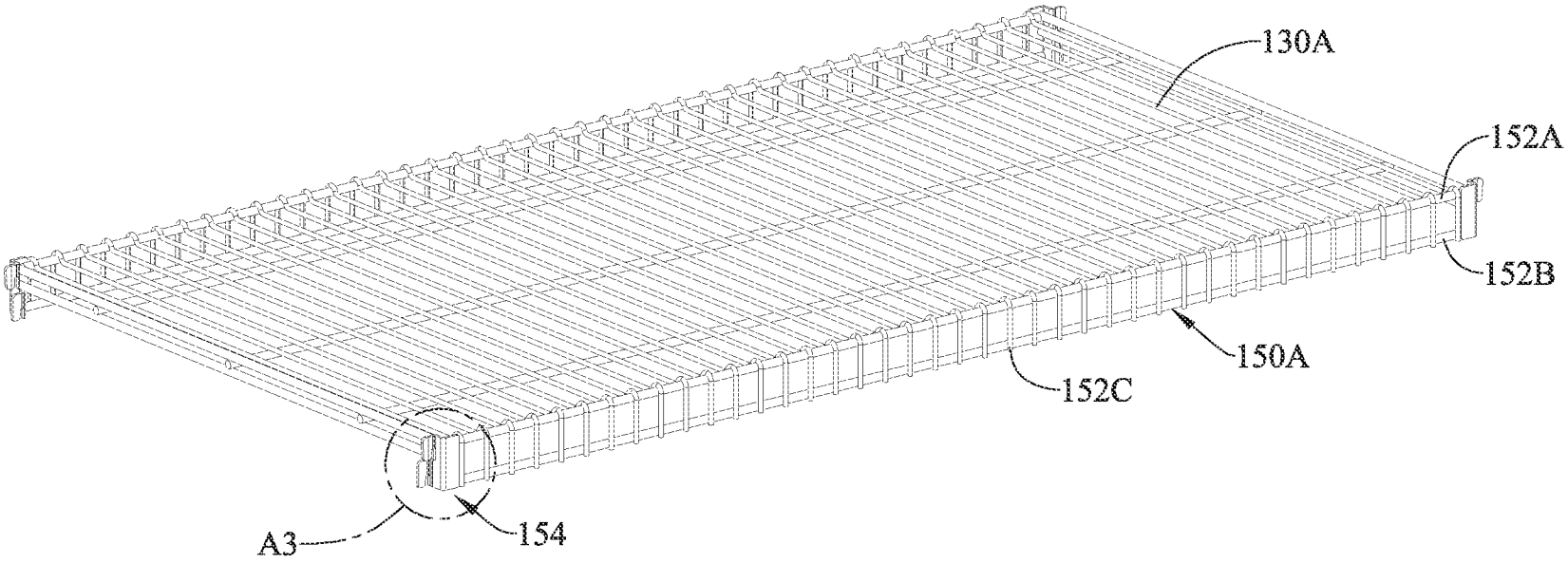
FIG. 4A is a schematic diagram of a first storage layer and beam structures of FIG. 1.
Figure 4B:
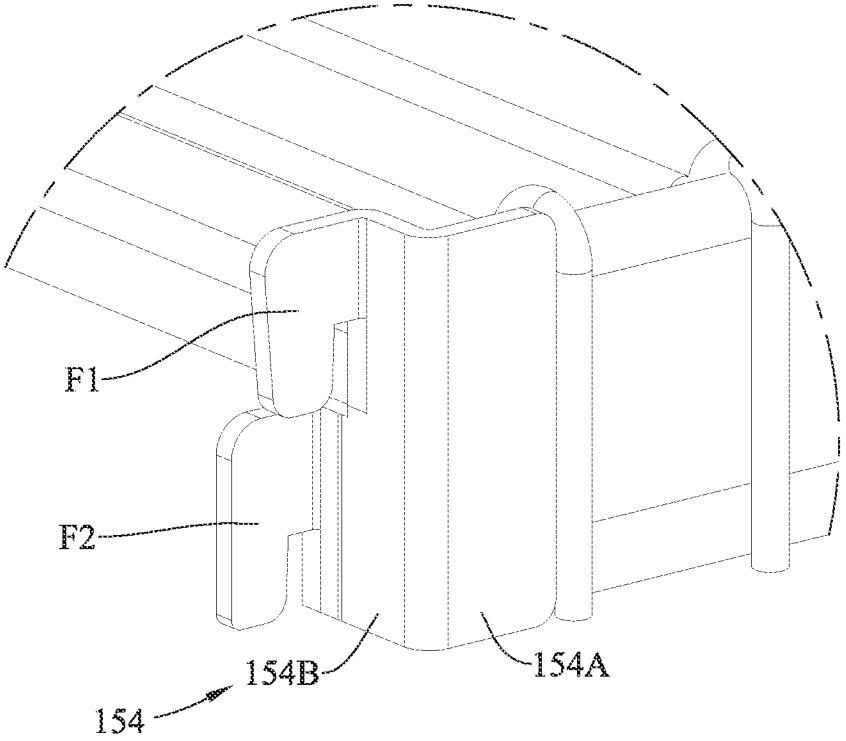
FIG. 4B is a partial enlarged view of a region A3 of FIG. 4A.
Figure 5A:
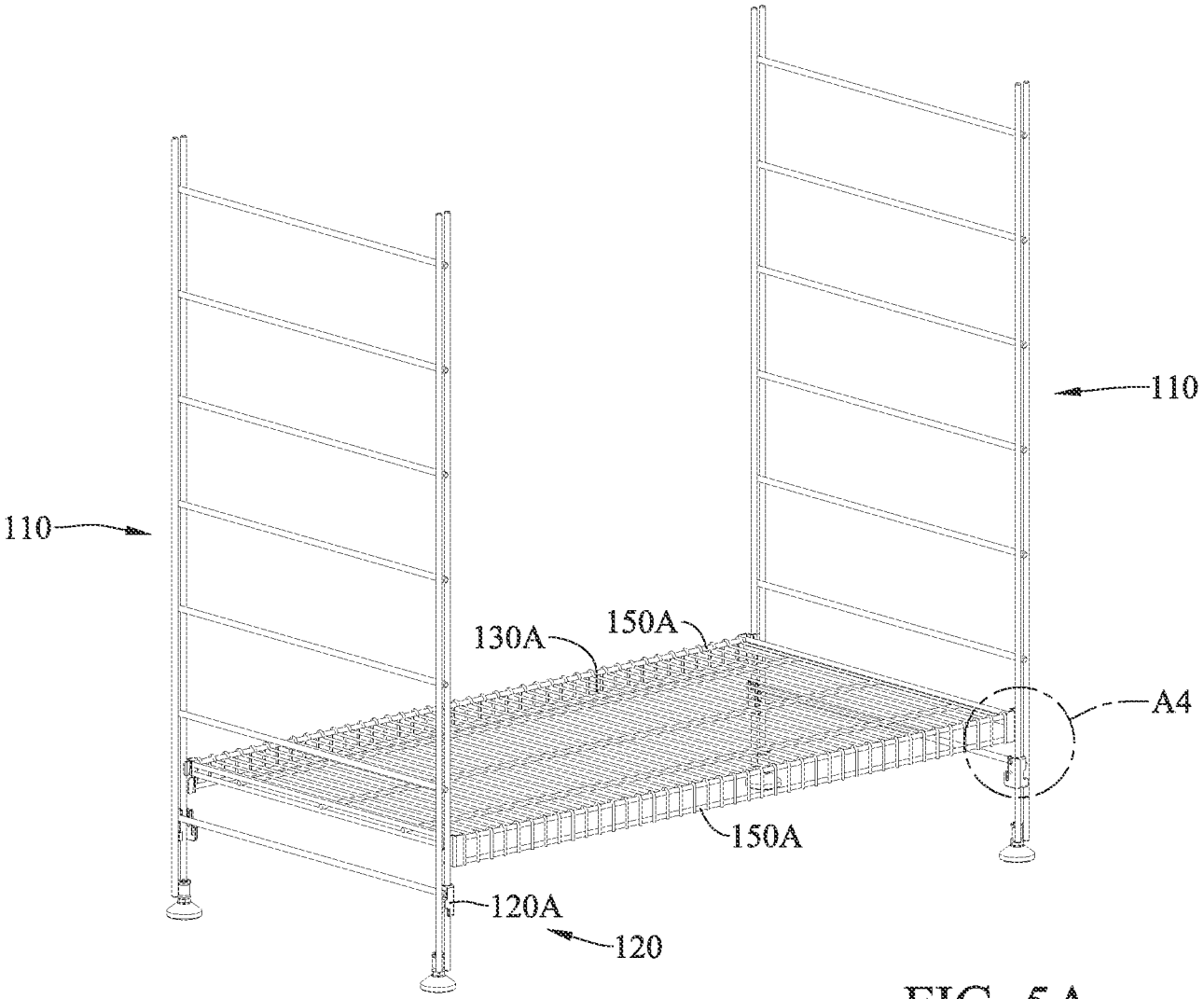
FIG. 5A is a schematic diagram of an assembly process of a first storage layer and double-bracing side racks in the combined storage shelf of FIG. 1.
Figure 5C:
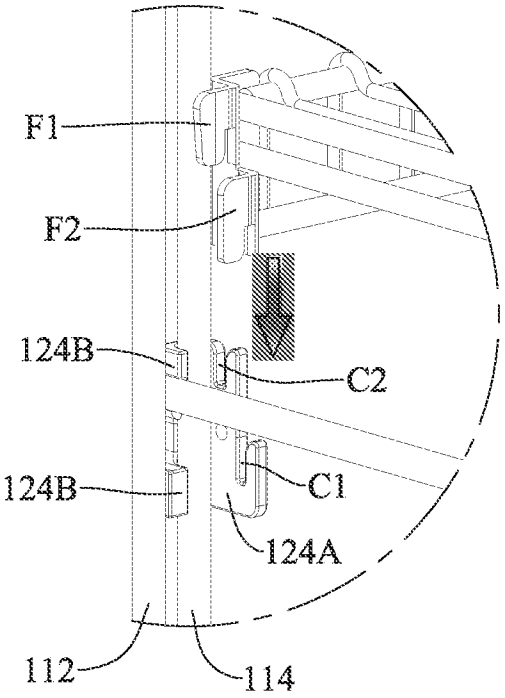
FIG. 5C is a schematic diagram of FIG. 5B from another perspective.
Figure 5B:
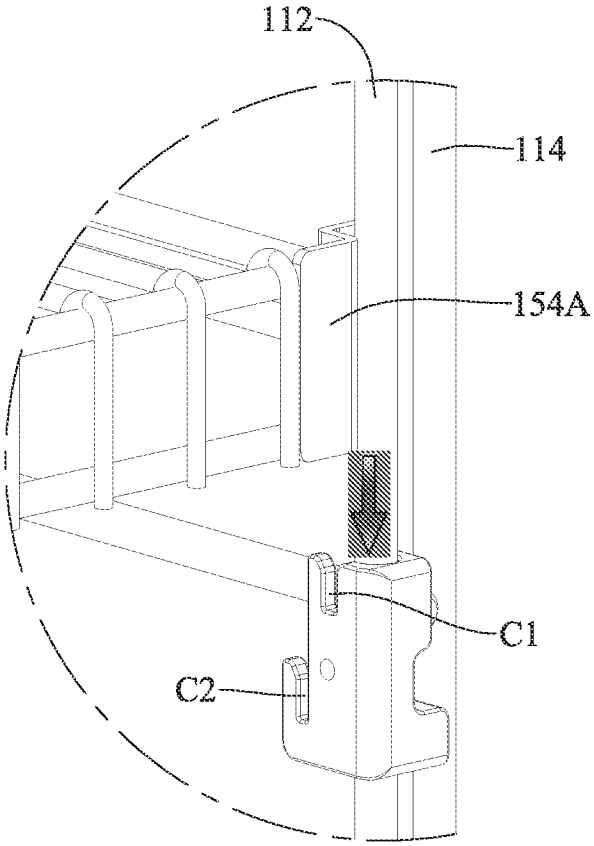
FIG. 5B is a partial enlarged view of a region A4 of FIG. 5A.

FIG. 4A is a schematic diagram of a first storage layer and beam structures of FIG. 1. FIG. 4B is a partial enlarged view of a region A3 of FIG. 4A. FIG. 5A is a schematic diagram of an assembly process of a first storage layer and double-bracing side racks in the combined storage shelf of FIG. 1. FIG. 5B is a partial enlarged view of a region A4 of FIG. 5A. FIG. 5C is a schematic diagram of FIG. 5B from another perspective. In this embodiment, corresponding beam structures 150A are disposed on front and rear sides of the first storage layer 130A respectively. Each of the beam structures 150A includes a beam member 152 and two beam connecting fasteners 154. Each of the beam connecting fasteners 154 is connected to two sides of a corresponding beam member 152. In this embodiment, each of the beam connecting fasteners 154 includes two beam fastening structures F1 and F2. The beam member 152 includes a first horizontal iron wire 152A, a second horizontal iron wire 152B, and a plurality of upright iron wires 152C. The first horizontal iron wire 152A and the second horizontal iron wire 152B are in parallel and have a space. The upright iron wires 152C are arranged in sequence and configured to connect the first horizontal iron wire 152A with the second horizontal iron wire 152B. The beam fastening structures F1 and F2 may be fastening blocks. In addition, as shown in FIG. 5B or FIG. 5C, positions of the beam fastening structures F1 and F2 may correspond to positions of the fastening structures C1 and C2. Therefore, when the first storage layer 130A and the beam structure 150A connected to the first storage layer 130A shown in FIG. 5A fall vertically, the beam fastening structures F1 and F2 are snapped into the corresponding fastening structures C1 and C2, so that the beam structure 150A is connected to corresponding connection and combination fasteners 120, and the first storage layer 130A is assembled to the double-bracing side rack 110. Similarly, when the beam structure 150B falls vertically, the beam fastening structures F1 and F2 are snapped into corresponding fastening structures C1 and C2, so that the beam structure 150B is connected to corresponding connection and combination fasteners 120. It should be noted that, the structure of the beam structure 150B is similar to that of the beam structure 150A. Details are not repeated herein again. Similarly, it can be inferred that other layers in the first row LL1 are also assembled by using the above techniques. In addition, in the first row LL1, for example, a first storage shelf body M1, a second storage shelf body M2, or a third storage shelf body M3 can be appropriately assembled, and the shapes thereof can be adjusted according to actual conditions. In addition, in FIG. 1, the first row LL1 includes connectors 5010, which can be used to combine a plurality of first upright rods 112 and a plurality of second upright rods 114 with a fixed length, so that the length of the entire double-bracing side rack 110 becomes longer. Certainly, in fact, the lengths of the first upright rod 112 and the second upright rod 114 may be directly increased, which may be unfavorable for transportation and placement. By assembling the plurality of first upright rods 112 and the plurality of second upright rods 114 with the fixed length, the assembling convenience can be improved.

Moreover, the beam connecting fastener 154 includes the beam fastening structures F1 and F2 mentioned above, but the present disclosure does not limit the type of the beam connecting fastener 154. In another embodiment, as shown in FIG. 4B, the beam connecting fastener 154 includes a beam body portion 154A and a first side portion 154B. The first side portion 154B is vertically connected to one side of the beam body portion 154A. It can be considered that the first side portion 154B is formed by bending one side of the beam body portion 154A. An other side of the beam body portion 154A is connected to the beam member 152. The beam fastening structures F1 and F2 are connected to one side of the first side portion 154B. It can be considered that the beam fastening structures F1 and F2 are formed by bending one side of the first side portion 154B. In view of the above, two sides of the first side portion 154B are respectively connected to the beam fastening structures F1 and F2 and the beam body portion 154A.

Figure 6A:
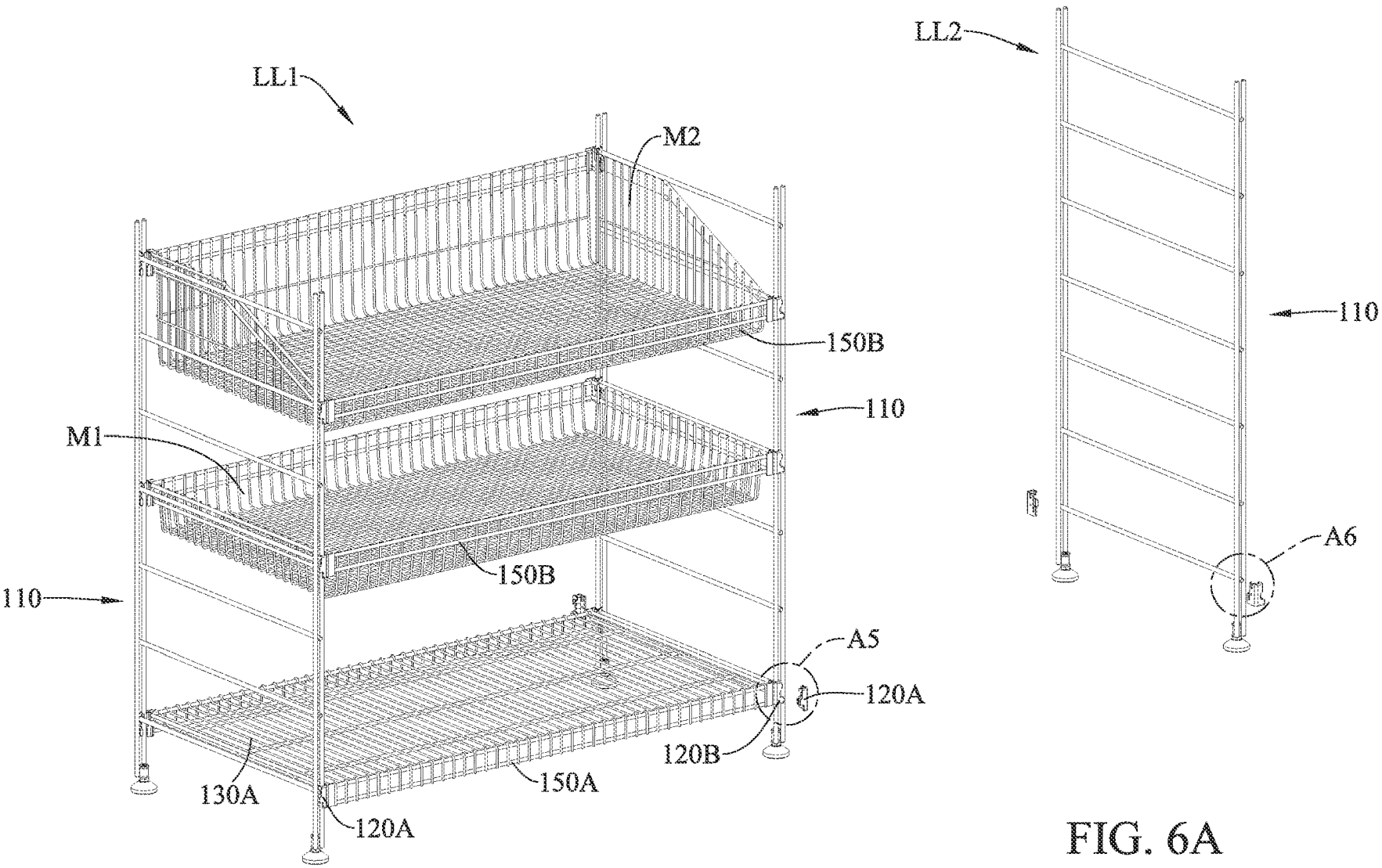
FIG. 6A is a schematic diagram of an assembly process of a double-bracing side rack in FIG. 1.
Figure 6C:
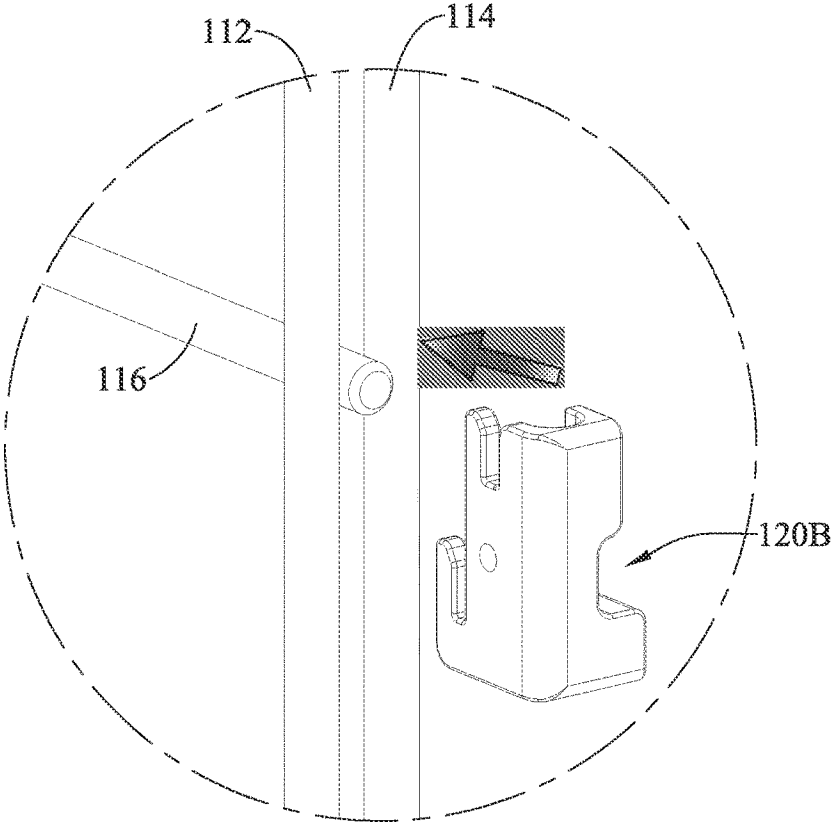
FIG. 6C is a partial enlarged view of a region A6 of FIG. 6A.
Figure 6B:
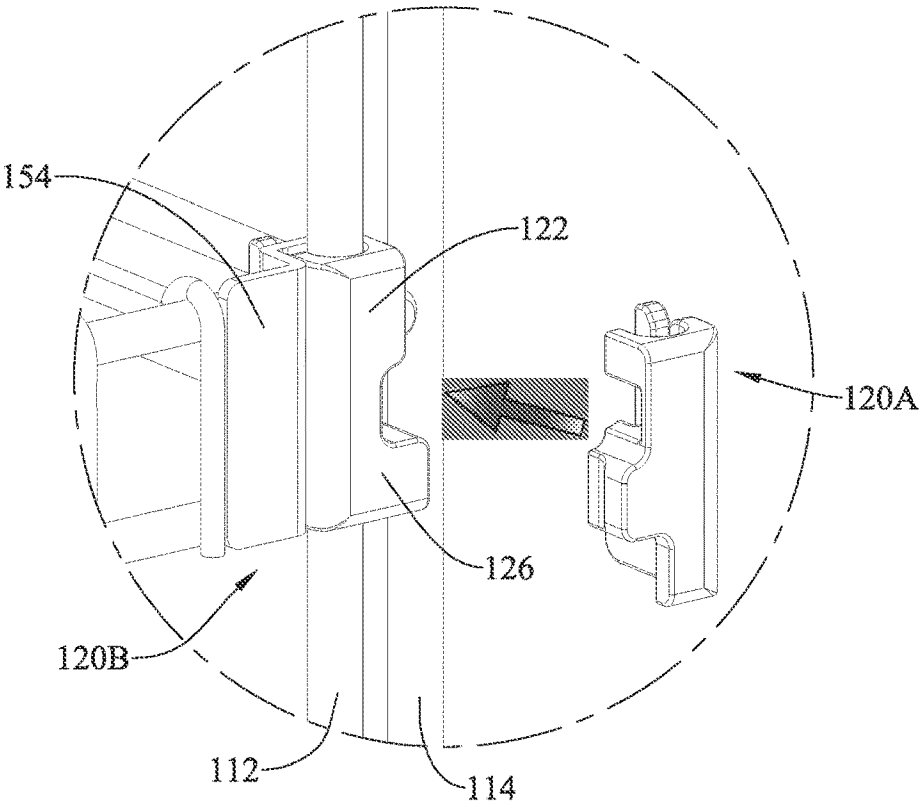
FIG. 6B is a partial enlarged view of a region A5 of FIG. 6A.

FIG. 6A is a schematic diagram of an assembly process of a double-bracing side rack in FIG. 1. FIG. 6B is a partial enlarged view of a region A5 of FIG. 6A. FIG. 6C is a partial enlarged view of a region A6 of FIG. 6A. Referring to FIG. 6A to FIG. 6C, and in combination with FIG. 3C and FIG. 3D, if the second row LL2 is to be assembled next to the first row LL1, as described above, because the connection and combination fastener 120 of the present disclosure is assembled to and disposed on only one of the first upright rod 112 or the second upright rod 114 in the double-bracing side rack 110, the connection and combination fastener 120 is assembled to an other of the first upright rod 112 or the second upright rod 114 when the second row LL2 is assembled. As shown in FIG. 6A and FIG. 6B, the second connection and combination fastener 120B is assembled to the first upright rod 112 of the double-bracing side rack 110. Therefore, the first connection and combination fastener 120A can be assembled to the second upright rod 114 of the double-bracing side rack 110. In addition, according to the descriptions of FIG. 3C and FIG. 3D, the first connection and combination fastener 120A and the second connection and combination fastener 120B can be assembled together with each other.

Then, as shown in FIG. 1, by using the first connection and combination fastener 120A or the second connection and combination fastener 120B, the beam structure 150C can be engaged with the double-bracing side rack 110. The structure and assembly method of the beam structure 150C are similar to those of the beam structure 150A described above. Detailed are not repeated herein again.

Figure 7:
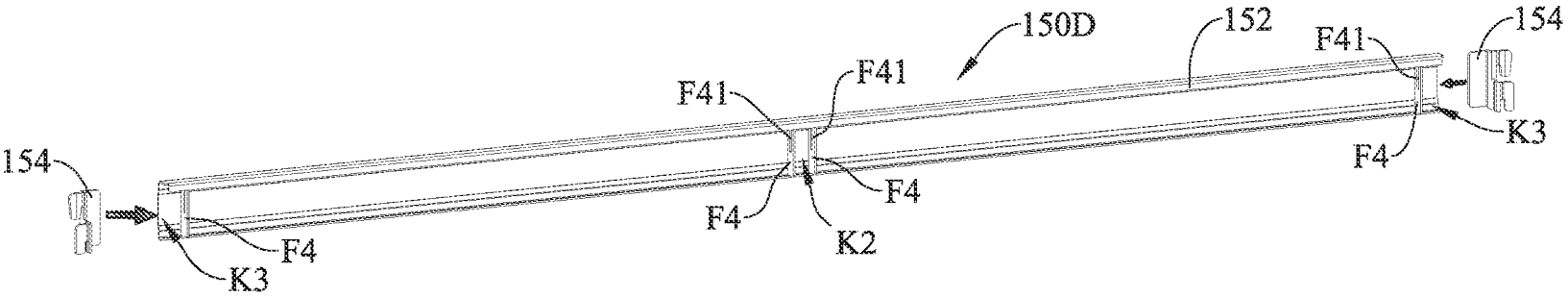
FIG. 7 is a schematic exploded view of a beam structure according to an embodiment.

In an embodiment, as shown in FIG. 1 and FIG. 7, the structure of a beam structure 150D is different from the structures of the beam structures 150A, 150B, and 150C described above. The beam structure 150D may include a plurality of fitting portions F4. The fitting portion F4 is connected to the beam member 152. As shown in FIG. 7, there are two fitting portions F4 in the middle of the beam member 152. Each of the fitting portions F4 includes a fitting hole F41, which can be configured to hook a fitting when needed to improve the assembly flexibility of the present disclosure. A positioning slot K2 is provided between the two fitting portions F4. In FIG. 7, the fitting portions F4 are also disposed on two sides of the beam member 152. A positioning slot K3 is formed between the fitting portions F4 and the corresponding beam connecting fasteners 152.

Figure 8:
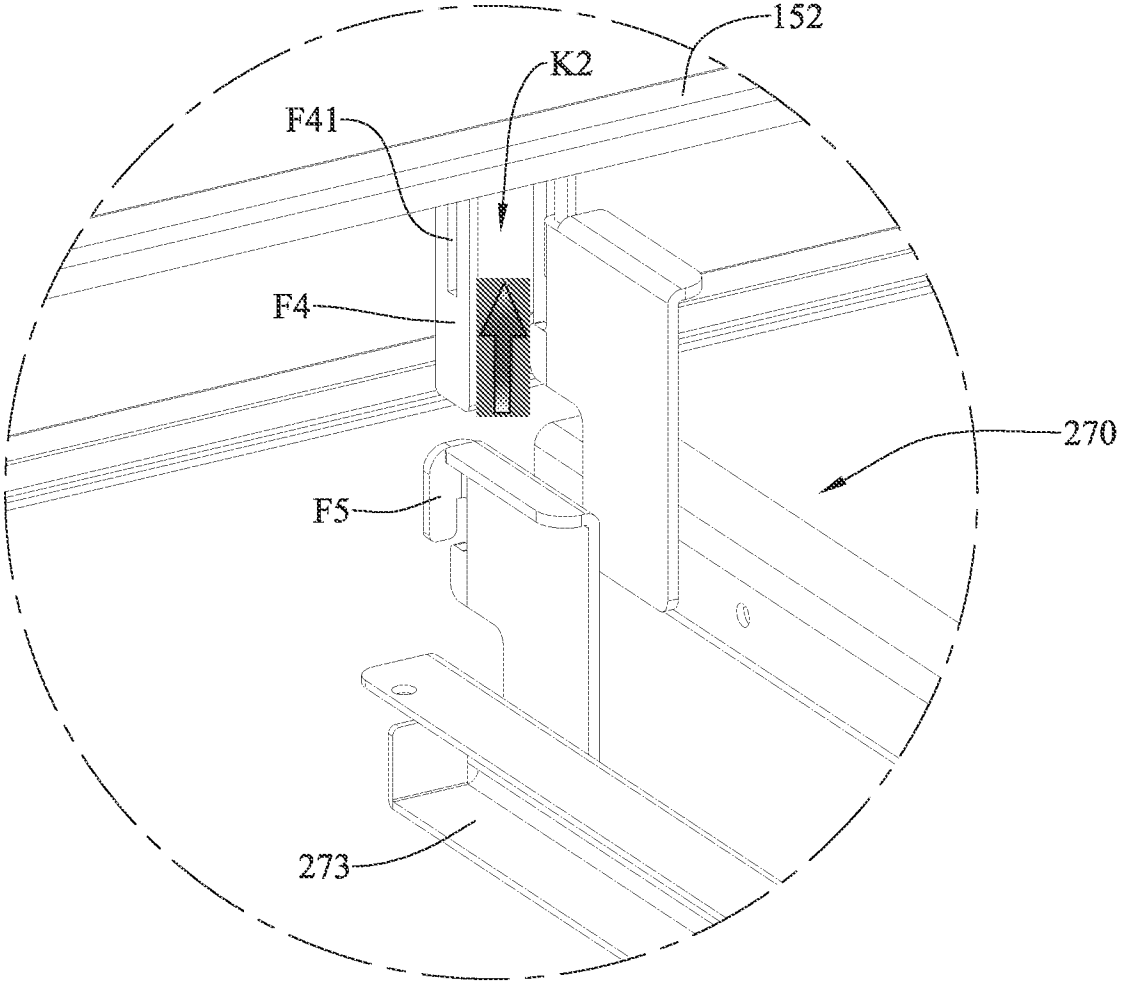
FIG. 8 is a schematic diagram of a combination of a fitting and a fitting portion according to an embodiment.
Figure 9:
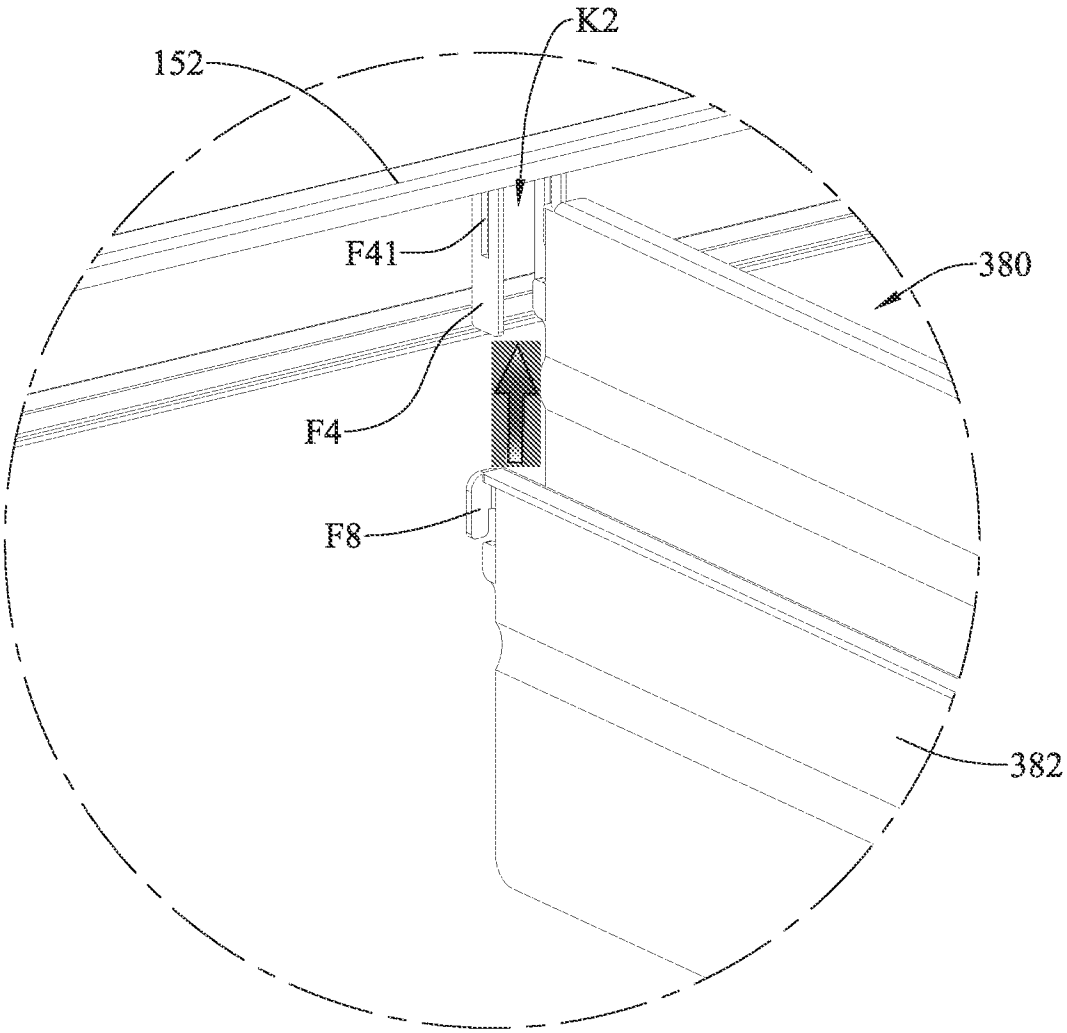
FIG. 9 is a schematic diagram of a combination of a fitting and a fitting portion according to another embodiment.

Taking FIG. 8 and FIG. 9 as an example, FIG. 8 corresponds to a position of the beam structure 150D of an assembly storage basket M5 in FIG. 1, and FIG. 9 corresponds to a position of the beam structure 150D of an assembly drawer M4 in FIG. 1. As shown in FIG. 8, a sliding groove structure 270 may be used as a fitting. The sliding groove structure 270 includes a sliding groove 273 and a plurality of hook portions F5. Each of the hook portions F5 protrudes from a corresponding groove 273. The hook portion F5 is hooked to a fitting hole F41 of a corresponding fitting portion F4. As shown in FIG. 9, a drawer track structure 380 may be used as a fitting. The drawer track structure 380 includes a board body 382, a sliding rail, and a plurality of hook portions F8. In another embodiment, a structure such as a sliding groove or an auxiliary wheel may be added when needed. Each of hook portion F8 protrudes from a surface of the board body 382. The hook portion F8 is hooked to a fitting hole F41 of a corresponding fitting portion F4 for assembling a component such as a drawer.

Figure 10:
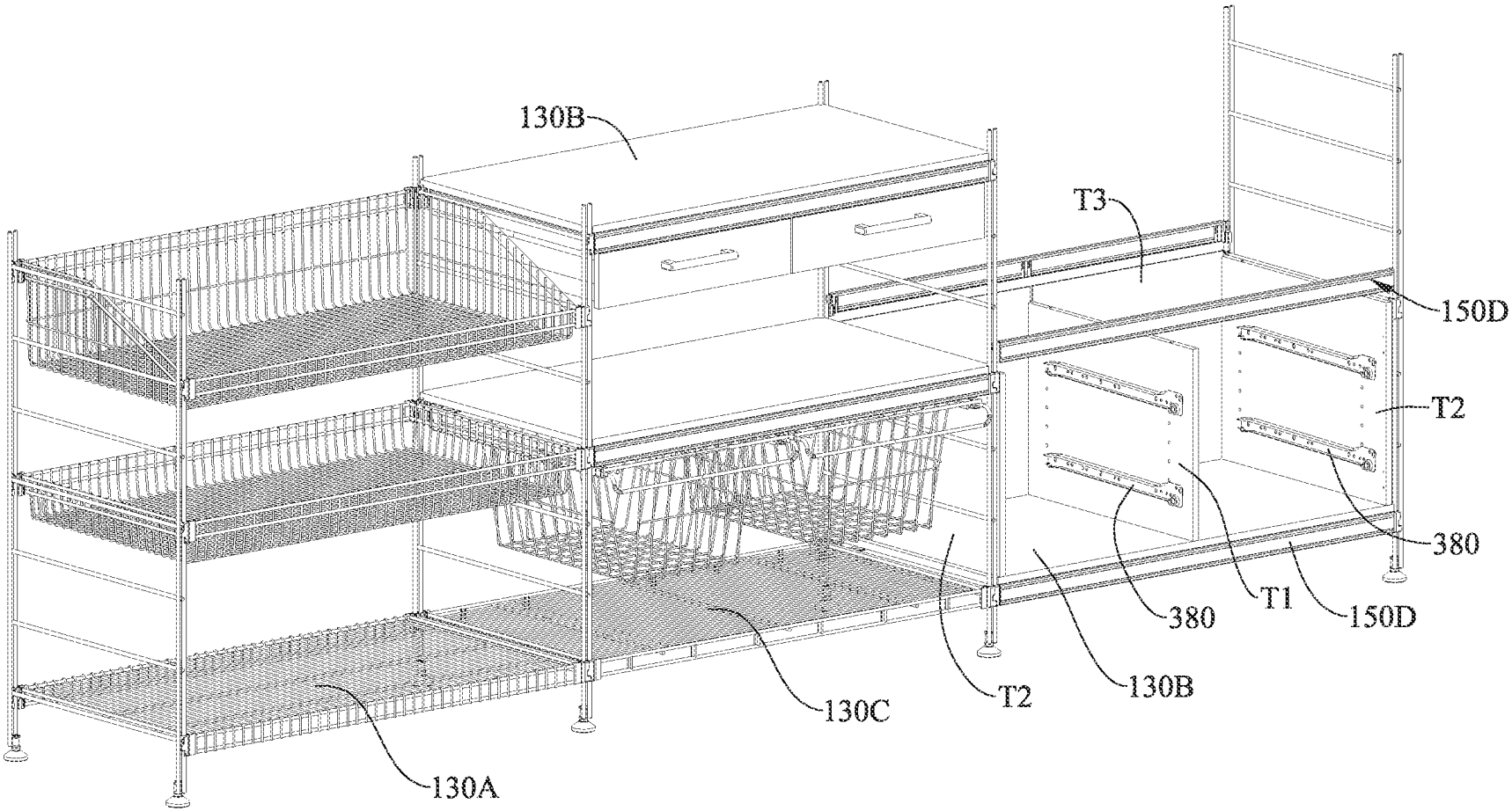
FIG. 10 is a schematic diagram of an assembly process of a combined storage shelf according to the present disclosure.

FIG. 10 is a schematic diagram of an assembly process of a combined storage shelf according to the present disclosure. A first partition member T1, a second partition member T2, a third partition member T3, and the like are partition members disposed according to different positions. The first partition member T1 and two second partition members T2 are respectively disposed upright on a second storage layer 130B. The first partition member T1 and the two second partition members T2 are separated by a distance respectively. In addition, a drawer track, a sliding rail, and the like may be disposed on the first partition member T1 and the two second partition members T2. The second storage layer 130B is different from mesh shapes of the first storage layer 130A and the third storage layer 130C, and the second storage layer 130B is flat.

In this embodiment, when the beam structure 150D falls, the positioning slots K2 and K3 shown in FIG. 7 above can hold the partition member T1 and the partition member T2, thereby positioning the partition member T1 and the partition member T2. In this way, the first partition member T1, the second partition member T2, and the third partition member T3 can form a drawer cabinet B1. That is, in this embodiment, by disposing the positioning slots K2 and K3 without locking, a drawer cabinet, a door cabinet or a storage cabinet can be assembled and positioned to save time and effort. In another embodiment, the partition members such as the first partition member T1, the second partition member T2, and the third partition member T3 can be used to form a storage cabinet B2 or a door cabinet B3 (refer to FIG. 1), which depends on actual conditions.

In conclusion, according to the combined storage shelf provided in the present disclosure, a beam structure is engaged with fastening structures of connection and combination fasteners on double-bracing side racks without tools for assembly, to achieve the purpose of engagement. In addition, the beam structure is used to stabilize the entire combined storage shelf without the need for the conventional cross-shaped traction wire structure.

Further, in the present disclosure, the combined storage shelf can be assembled as long as the connection and combination fastener is assembled to one of a first upright rod or a second upright rod in the double-bracing side rack. In this way, the costs of manufacturing the connection and combination fastener can be effectively reduced.

In addition, the beam structure includes a hooking function, and a fitting may be added according to actual needs, to make the entire combined storage shelf more flexible in assembly.

In addition, the present disclosure adopts the method of disposing the positioning slots in the beam member without locking, so that a drawer cabinet, a door cabinet or a storage cabinet can be assembled and positioned to save time and effort.

Although the present disclosure is described with reference to the above embodiments, the embodiments are not intended to limit the present disclosure. A person of ordinary skill in the art may make variations and modifications without departing from the spirit and scope of the present disclosure. Therefore, the protection scope of the present disclosure should be subject to the appended claims.

What is claimed is:

1. A combined storage shelf, comprising:

at least two double-bracing side racks, wherein each of the double-bracing side racks comprises two upright rod combinations and a plurality of horizontal rods, the horizontal rods are disposed between the upright rod combinations, each of the upright rod combinations comprises a first upright rod and a second upright rod, the first upright rod and the second upright rod are disposed in parallel, and two ends of the horizontal rods are respectively fastened between the first upright rod and the second upright rod;

a plurality of connection and combination fasteners, wherein each of the connection and combination fasteners comprises a body portion, a first side portion, a second side portion, a fitting groove, and at least one fastening structure, two sides of the body portion respectively extend to form the first side portion and the second side portion, each fastening structure is disposed in the corresponding first side portion, the fitting groove is provided in the second side portion, the second side portion is inserted between the first upright rod and the second upright rod, and each of the horizontal rods is fastened to a corresponding fitting groove, so that the body portion and the first side portion are respectively located on an outer side of the first upright rod or the second upright rod;

a plurality of storage layers, located between the double-bracing side racks; and a plurality of beam structures, wherein the storage layers are disposed on the corresponding beam structures, each of the beam structures comprises a beam member and two beam connecting fasteners, the beam connecting fasteners are respectively connected to two sides of the beam member, each of the beam connecting fasteners comprises at least one beam fastening structure, and each beam fastening structure is snapped into a corresponding fastening structure of the corresponding connection and combination fasteners, so that the beam structures are connected to the corresponding connection and combination fasteners, wherein each beam fastening structure is a hook.

2. The combined storage shelf according to claim 1, wherein the plurality of connection and combination fasteners comprises a first connection and combination fastener and a second connection and combination fastener, each of the first connection and combination fastener and the second connection and combination fastener comprises a protrusion portion and a concave hole portion, the protrusion portion is connected to the body portion, the protrusion portion protrudes from one side of the body portion, the concave hole portion is adjacent to the protrusion portion, the protrusion portion of the first connection and combination fastener is engaged with the concave hole portion of the second connection and combination fastener, and the concave hole portion of the first connection and combination fastener is engaged with the protrusion portion of the second connection and combination fastener, so that the first connection and combination fastener and the second connection and combination fastener are assembled together.

3. The combined storage shelf according to claim 1, further comprising: a plurality of fitting portions, wherein two corresponding fitting portions from the plurality of fitting portions is connected to each beam member.

4. The combined storage shelf according to claim 3, further comprising:

a fitting, comprising a plurality of hook portions, wherein the hook portions are hooked to corresponding fitting portions.

5. The combined storage shelf according to claim 3, further comprising:

a plurality of positioning slots, provided between the fitting portions, between the fitting portions and the corresponding beam connecting fasteners, or within the beam connecting fasteners, wherein each of the positioning slots is configured to hold at least one corresponding partition member, to position the partition members on the storage layers.

6. The combined storage shelf according to claim 5, wherein the partition members form a drawer cabinet, a door cabinet, or a storage cabinet.

7. The combined storage shelf according to claim 1, wherein each fastening structure is a fitting hole of a corresponding side portion.

* * * * *